US009968997B2

(12) United States Patent
Wang et al.

(10) Patent No.: US 9,968,997 B2
(45) Date of Patent: May 15, 2018

(54) METAL FORMING APPARATUS

(71) Applicant: BYD COMPANY LIMITED, Shenzhen (CN)

(72) Inventors: Yanan Wang, Shenzhen (CN); Qiuhui Chen, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 136 days.

(21) Appl. No.: 15/028,991

(22) PCT Filed: Oct. 15, 2014

(86) PCT No.: PCT/CN2014/088649

§ 371 (c)(1),
(2) Date: Apr. 13, 2016

(87) PCT Pub. No.: WO2015/058644

PCT Pub. Date: Apr. 30, 2015

(65) Prior Publication Data

US 2016/0271685 A1 Sep. 22, 2016

(30) Foreign Application Priority Data

Oct. 23, 2013 (CN) ..... 2013 1 0505189
Oct. 23, 2013 (CN) ..... 2013 2 0658042 U

(51) Int. Cl.
*B22D 17/10* (2006.01)
*B22D 17/14* (2006.01)
(Continued)

(52) U.S. Cl.
CPC ..... *B22D 17/14* (2013.01); *B22D 17/10* (2013.01); *B22D 17/203* (2013.01);
(Continued)

(58) Field of Classification Search
CPC ..... B22D 17/10; B22D 17/14; B22D 17/20; B22D 17/2023; B22D 17/203;
(Continued)

(56) References Cited

U.S. PATENT DOCUMENTS 4,335,778 A 6/1982 Motomura et al.
4,510,371 A * 4/1985 Nakamura et al. .... B23K 15/00 219/121.35
(Continued)

FOREIGN PATENT DOCUMENTS

CN 1509829 A 7/2004
CN 1572393 A 2/2005
(Continued)

OTHER PUBLICATIONS

The World Intellectual Property Organization (WIPO) International Search Report for PCT/CN2014/088649 dated Jan. 16, 2015.

*Primary Examiner* — Kevin P Kerns
(74) *Attorney, Agent, or Firm* — Anova Law Group, PLLC

(57) ABSTRACT

A metal forming apparatus includes an injection device and a displacement speed monitoring device. The injection device includes a moveable injection rod defining a sliding channel, and a magnet ring disposed on the injection rod, the displacement speed monitoring device includes a housing sealedly connected to the injection device, and a linear displacement sensor disposed in the housing, a rear end of the injection rod is extended into the housing such that a front end of the linear displacement sensor is located in the sliding channel.

9 Claims, 6 Drawing Sheets

(51) Int. Cl.

| | |
|---|---|
| ***B22D 17/20*** | (2006.01) |
| ***B22D 17/28*** | (2006.01) |
| ***B22D 17/30*** | (2006.01) |
| ***B22D 17/32*** | (2006.01) |
| ***B22D 27/15*** | (2006.01) |
| ***B22D 27/00*** | (2006.01) |

(52) U.S. Cl.
CPC ..... *B22D 17/2023* (2013.01); *B22D 17/2038* (2013.01); *B22D 17/28* (2013.01); *B22D 17/30* (2013.01); *B22D 17/32* (2013.01); *B22D 27/003* (2013.01)

(58) Field of Classification Search
CPC .... B22D 17/2038; B22D 17/28; B22D 17/30; B22D 17/32; B22D 27/003; B22D 27/15
USPC ..... 164/312, 253, 256, 335, 155.5
See application file for complete search history.

(56) References Cited

U.S. PATENT DOCUMENTS 4,884,621 A 12/1989 Ban et al.
5,887,641 A * 3/1999 Iwamoto et al. ..... B22D 17/32 164/113
2008/0206382 A1* 8/2008 Yokoyama et al. . B22D 17/266 425/135

FOREIGN PATENT DOCUMENTS

| | | | |
|---|---|---|---|
| CN | 101239373 | A | 8/2008 |
| CN | 201157892 | Y | 12/2008 |
| CN | 201168774 | Y | 12/2008 |
| CN | 201231307 | Y | 5/2009 |
| CN | 201693151 | U | 1/2011 |
| CN | 102451898 | A | 5/2012 |
| CN | 202398798 | U | 8/2012 |
| CN | 202877514 | U | 4/2013 |
| CN | 203610637 | U | 5/2014 |
| CN | 203679217 | U | 7/2014 |
| JP | H08304021 | A | 11/1996 |
| JP | H09122879 | A | 5/1997 |
| JP | H10296739 | A | 11/1998 |
| JP | 2011131225 | A | 7/2011 |
| JP | 2013099756 | A | 5/2013 |
| JP | 2013128947 | A | 7/2013 |
| KR | 100253814 | B1 | 4/2000 |

* cited by examiner

A

METAL FORMING APPARATUS

CROSS REFERENCE TO RELATED APPLICATIONS

This application claims priority and benefits of Chinese Patent Applications No. 201310505189.5 and 201320658042.5, both filed with State Intellectual Property Office on Oct. 23, 2013, the entire contents of the above identified applications are incorporated herein by reference.

FIELD

Embodiments of the present disclosure generally relate to a metal smelting field, and more particularly, to a metal forming apparatus.

BACKGROUND

A vacuum die-casting machine, which is improved based on a traditional die-casting machine, is generally sealed by adopting a dynamic-sealed connection between an injection rod and a guiding seal assembly; and the dynamic-sealed connection is configured as a radial seal. When a displacement data is required to be collected, a location of a hammer header is generally determined when a contacting ring disposed on the injection rod touches a switch, that is the displacement date is collected by a fixed point measurement. Therefore, the real-time location of the hammer cannot be obtained. In addition, a sealing effect of this structure is often unsatisfied. Especially when the injection rod repeatedly moves backward and forward, a vacuum seal of an injection system often cannot be guaranteed, which may bring great damage to the stability of performance of the whole machine.

SUMMARY

Embodiments of the present disclosure seek to solve at least one of the problems existing in the related art to at least some extent.

Accordingly, an objective of the present disclosure is to provide a metal forming apparatus which can ensure a large scale production of readily oxidized metals and easily achieve the vacuum seal.

Embodiments of a broad aspect of the present disclosure provide a metal forming apparatus, which includes: an injection device, including a moveable injection rod defining a sliding channel, and a magnet ring disposed on the injection rod; and a displacement speed monitoring device, comprising a housing hermetically connected to the injection device, and a linear displacement sensor disposed in the housing; wherein a rear end of the injection rod is extended into the housing such that a front end of the linear displacement sensor is located in the sliding channel.

With the metal forming apparatus according to the present disclosure, a static sealed connection is formed between the injection device and the displacement speed monitoring device, which is easier to implement the vacuum seal. Furthermore, the pressure maintaining performance which is significant to a forming of the amorphous alloy is improved.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
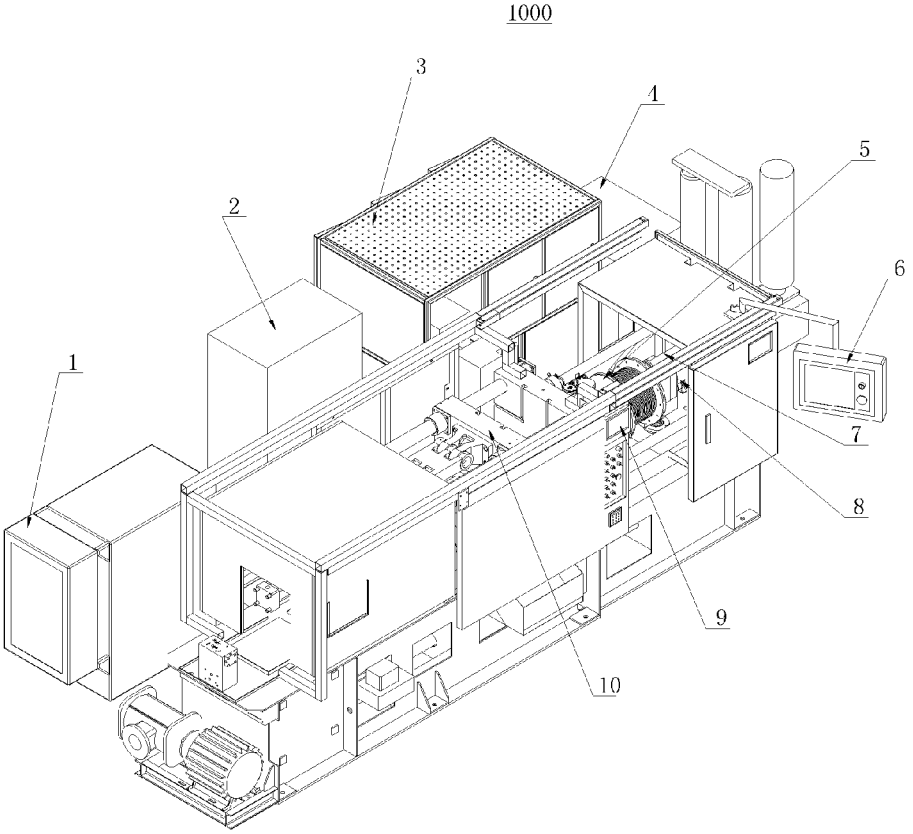
FIG. 1 is a perspective view of a metal forming apparatus according to an embodiment of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom", "inner", "outer", "clockwise", "anticlockwise" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance. Thus, features limited by "first" and "second" are intended to indicate or imply including one or more than one these features. In the description of the present disclosure, "a plurality of" relates to two or more than two.

In the description of the present disclosure, unless specified or limited otherwise, it should be noted that, terms "mounted," "connected" "coupled" and "fastened" may be understood broadly, such as permanent connection or detachable connection, electronic connection or mechanical connection, direct connection or indirect connection via intermediary, inner communication or interaction between two elements. Those having ordinary skills in the art should understand the specific meanings in the present disclosure according to specific situations.

A metal forming apparatus 1000 according to embodiments of the present disclosure will be described in the following with reference to FIGS. 1-11. The metal forming apparatus 1000 is configured to process and mold raw metal material into a metal element with a predetermined shape. The raw metal material may contain a readily oxidized metal, such as an amorphous alloy.

As shown in FIGS. 1-11, the metal forming apparatus according to embodiments of the present disclosure includes a smelting device 5, a molding device 10, an injection device 8 and a vacuum device 3. The smelting device 5 is configured to smelt a raw material (for example, the raw metal material) into a molten raw material. The smelting device 5 defines a smelting chamber 501 having a feeding port 508. A rotatable crucible 502 is disposed in the smelting chamber 501 and is configured to contain the raw material. In an embodiment, the crucible is located right below the feeding port 508 so as to receive the raw material via the feeding port 508. A heating unit 003 is disposed in the smelting chamber 501 and is configured to heat the raw material in the crucible 502 to obtain the molten raw material. In other words, the raw material in the crucible 502 is heated by the heating unit 003 to obtain the molten raw material.

The molding device 10 defines a molding chamber sealedly communicated with the smelting chamber 501 and is adapted to process and mold the molten raw material into the metal element with the predetermined shape, which is also referred as a metal molding process herein.

It should be noted that, expressions such as "sealedly communicated", "sealedly connected", "sealed connection" or the like herein means that a first component having a first chamber therein is connected with a second component having a second chamber therein such that the first chamber is communicated with the second chamber (i.e. one combined chamber is formed by communicating the first and second chambers), while the remaining part of the first component surrounding the first chamber is connected with the remaining part of the second component surrounding the second chamber to seal the combined chamber. Alternatively, these expressions also include the condition that a third component having a third chamber therein is connected with a fourth component having no chamber therein, while the third chamber is sealed by the connection between the third and fourth components.

The injection device 8 includes a charging barrel assembly 81 and an injection unit. The charging barrel assembly 81 is disposed at a joint between the molding device 10 and the smelting device 5. A part of the charging barrel assembly 81 is extended into the smelting chamber 501 and is located below the crucible 502 to receive the molten raw material. In some embodiments, when the raw material in the crucible 502 is melted into the molten raw material, the crucible 502 is rotated to pour the molten raw material into the charging barrel assembly 81, which is also referred as a feeding process of the raw material. An end of the injection unit is extended through the smelting chamber 501 into the charging barrel assembly 81 so as to inject the molten raw material in the charging barrel assembly 81 into the molding device 10 (for example, the molding chamber), thus implementing an injection process of the raw material. The injection unit is sealedly connected with the smelting device 5. In other words, a part of the injection device 8 penetrates through the smelting device 5. With the sealing connection between the injection device 8 and the smelting device 5, a first space in the injection device 8 to be vacuumized and a second space in the smelting device 5 to be vacuumized (for example, the smelting chamber) are coincided.

The vacuum device 3 is sealedly connected with the smelting device 5 and the molding device 10 respectively so as to vacuumize the smelting chamber 501 and the molding device 10. The vacuum device 3 is configured to vacuumize the first space defined by the injection device 8 and the second space in the smelting device 5 such as the smelting chamber 501, thereby providing interiors of the injection device 8 and the smelting device 5 with a vacuum environment. Moreover, the vacuum device 3 is further configured to vacuumize the molding device 10, such that all processes of the smelting, feeding, injecting and molding of the raw material can be operated under a vacuum environment.

During operation of the metal forming apparatus 1000, firstly, the raw material is fed into the crucible 502 via the feeding port 508, and then the smelting device 5, the injection device 8 and the molding device 10 are all vacuumized by the vacuum device 3. Next, the crucible 502 is heated by the heating unit 003. When the raw material in the crucible 502 is heated into the molten raw material, the crucible 502 is rotated to pour the molten raw material into the charging barrel assembly 81. Subsequently, the molten raw material in the charging barrel assembly 81 is injected into the molding chamber of the molding device 10 by the injection unit of the injection device 8, and the molten raw material is processed and molded by the molding device 10, thus obtaining the metal element with the predetermined shape. With the above-identified smelting, feeding, injecting and molding processes of the raw metal material, the final metal element may be obtained.

In some embodiments, the metal forming apparatus 1000 further includes a temperature control system 1 configured to control a temperature of the molding device 10, an electric control system 2 configured for an electric control of the whole apparatus, a CCD system 9 configured to provide a real-time video of the smelting process, and a man-machine terminal control system 6 configured to provide an man-machine operation interface and to monitor the forming information.

With the metal forming apparatus 1000 according to embodiments of the present disclosure, the charging barrel assembly 81 is disposed at the joint between the molding device 10 and the smelting device 5, a part of the charging barrel assembly 81 is located below the crucible 502, and a part of the injection unit is extended into the charging barrel assembly 81 through the smelting chamber 501. In other words, the injection device 8 penetrates through the smelting device 5, such that the space of the injection device 8 to be vacuumized and the space of smelting device 5 to be vacuumized (for example, the smelting chamber) are coincided (i.e. the two space are combined as one). Thus, the total space to be vacuumized by the vacuum device 3 is greatly reduced, which improves the sealing property and the pressure maintaining performances of the vacuum space. Moreover, the vacuum device 3 can achieve the requirement of vacuum for the smelting of the readily oxidized metals in a short time, thus ensuring a large scale production of the readily oxidized metals.

Figure 2:
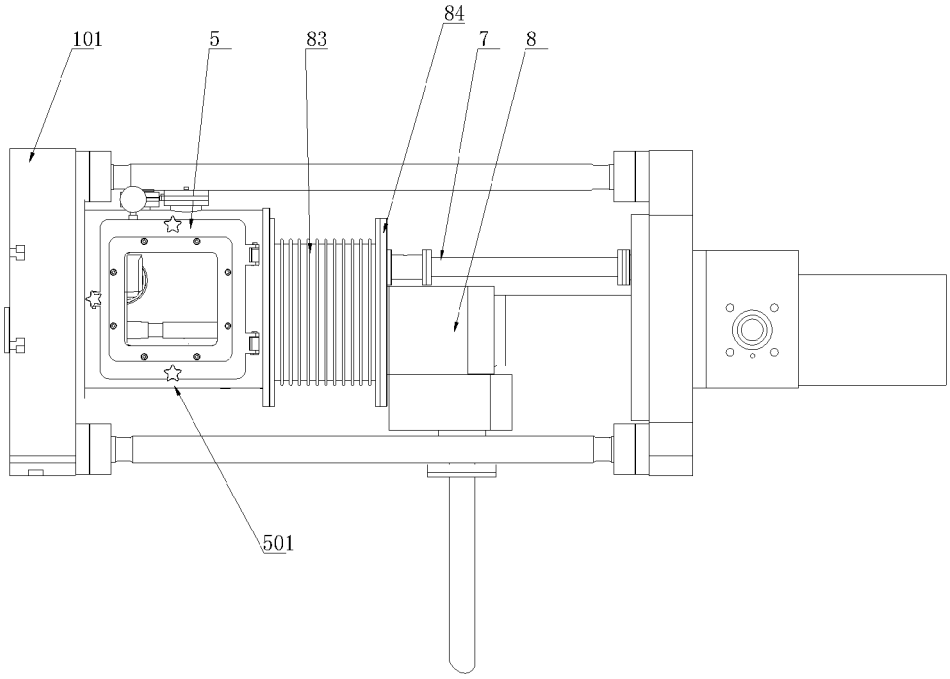
FIG. 2 is a schematic view of a smelting device and an injection device of a metal forming apparatus according to an embodiment of the present disclosure.
Figure 3:
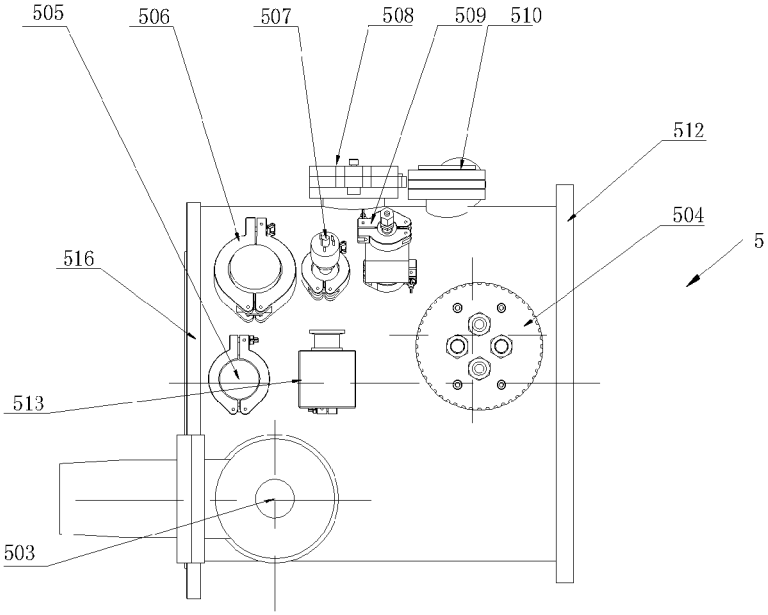
FIG. 3 is a rear view of a smelting device of a metal forming apparatus according to an embodiment of the present disclosure.
Figure 10:
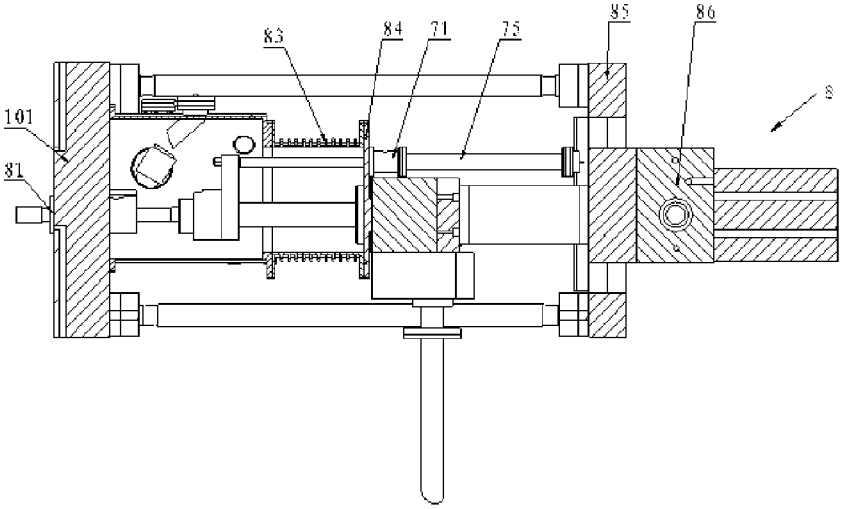
FIG. 10 is a cross-sectional view of an injection device and a smelting device of a metal forming apparatus according to an embodiment of the present disclosure.

In some embodiments of the present disclosure, as shown in FIGS. 2, 3 and 10, a rear end of the smelting chamber 5 is open and a first flange 512 is disposed at the rear end of the smelting chamber 5. An adapter flange 84 is disposed at a part of the injection unit located out of the smelting chamber 501, and the first flange 512 is sealedly connected with the adapter flange 84 via a vacuum seal bellow 83. In some embodiments, the vacuum seal bellow 83 is a flexible element, which may compensate design errors of the smelting chamber 501, the injection unit and the vacuum seal bellow 83. Also, since the vacuum seal bellow 83 is flexible, vibration effects generated by a of the metal forming apparatus 1000 and applied on each component can be absorbed, thus improving a safety and a stability of the metal forming apparatus 1000. It should be noted that, the injection unit may be sealedly connected with the smelting chamber 501 via other connection manners, which is not limited to the vacuum seal bellow 83 as described in this embodiment.

In some embodiments of the present disclosure, as shown in FIGS. 2, 3, 9 and 10, a front end of the smelting chamber 501 is open and a second flange 516 is disposed at the front end of the smelting chamber 501. A head plate 101 is disposed at a rear end of the molding device 10 and sealedly fit with the second flange 516, and the charging barrel assembly 81 is configured to extend through the head plate 101, such that the sealed connection between the molding device 10 and the smelting device 5 can be formed easily.

In the following, the structure of the smelting device 5 will be described in details with reference to FIGS. 3-5.

Figure 4:
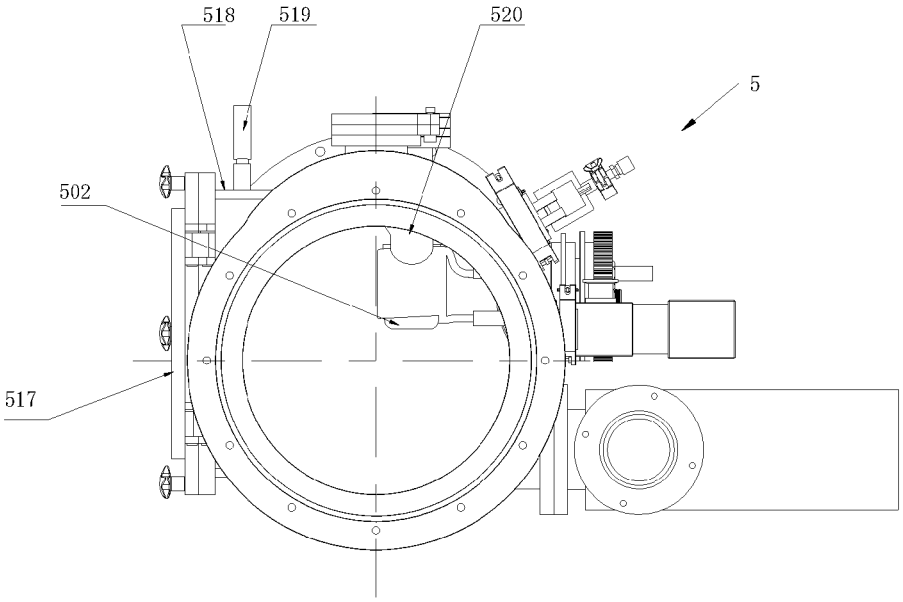
FIG. 4 is a right view of the smelting device shown in FIG. 3.
Figure 5:
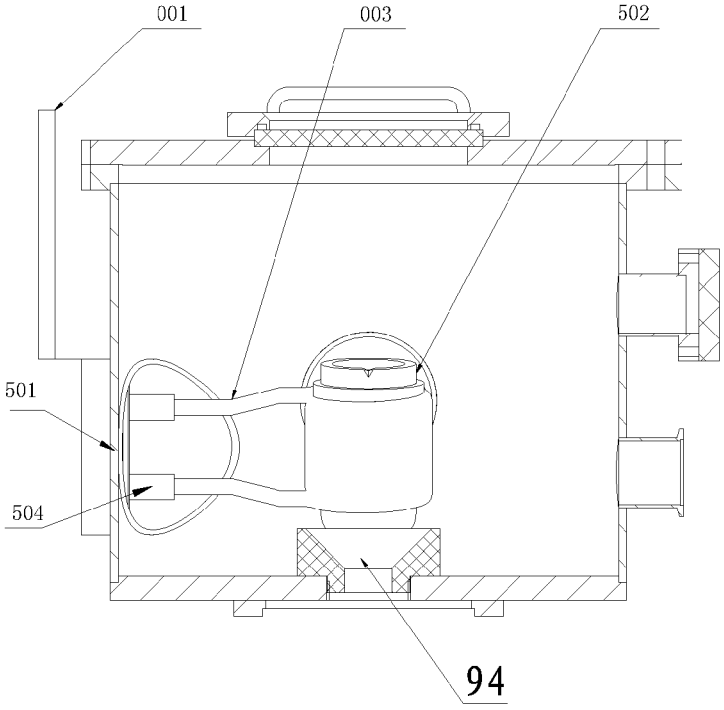
FIG. 5 is a cross-sectional view of the smelting device shown in FIG. 3.

As shown in FIGS. 3-5, the smelting device 5 includes a smelting chamber 501 defined therein, a crucible 502, a vacuumizing assembly 503, a water-cooled electrode assembly 504, a reserved port 505, a lead terminal assembly 506, a high vacuum gauge tube 507, a feeding port 508, an inert gas port 509, a CCD terminal port 510, an air discharging valve 513, a observing window 517, a vacuum meter 519 and a feeding passage 520. The two ends of the smelting chamber 501 are open, and the first flange 512 and the second flange 516 are disposed at the two ends of the smelting chamber 501 respectively. The smelting chamber 501 has a cross section of substantial elliptic shape, in other words, the cross-section of the smelting chamber 501 has a rectangular middle portion and two curved end portions disposed at two ends of the middle portion.

Compared with a sphere structure or a cylindrical structure generally adopted in the metal forming apparatus in the related art, the smelting chamber 501 is configured as the substantial ellipsoid shape, such that a volume of the smelting chamber 501 can be reduced greatly, thus decreasing a vacuumizing time. In some embodiments, the chamber may have other shapes, as long as the volume of the chamber is reduced or in other words the space needs to be vacuumized is reduced.

As shown in FIGS. 3 and 4, the crucible 502 is disposed within the smelting chamber 501 and is protected by an inert gas after the raw material is poured into the crucible 502. The crucible 502 is connected with the water-cooled electrode assembly 504 which can rotate to drive the crucible 502 to rotate under a vacuum seal condition. In some embodiments, the inert gas port 509 is disposed in the smelting device 5 and communicated with the smelting chamber 501, so that the inert gas may be sprayed into the smelting chamber 501 via the inert gas port 509. The inert gas port 509 may be provided with a spray nozzle located within the smelting chamber 501, and a position of the spray nozzle is corresponding to that of the crucible 502. After the molten raw material is poured into the charging barrel assembly 81 by the rotation of the crucible 502, the crucible 502 is quickly returned to the position which corresponds to the spray nozzle. The spray nozzle is connected with the inert gas port 509 via a conventional PU pipe or a metal pipe (as shown in FIG. 3), and the feeding time of the inert gas and the quantity of the inert gas can be controlled via the inert gas port 509. Therefore, before the molding device 10 is open, the temperature of the crucible 502 has been rapidly reduced by with the protection of the inert gas. In this way, even the smelting chamber 501 is exposed in an atmospheric environment, the crucible 502 cannot be oxidized because of decreasing temperature, thus well protecting the smelting device 5. As described above, the metal forming apparatus 1000 is simple and reliable. In an embodiment of the present disclosure, the inert gas is argon.

Figure 6:
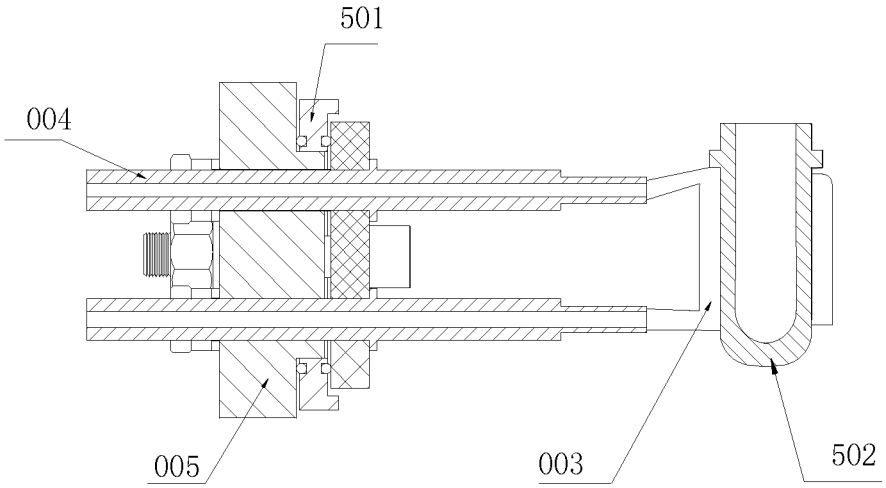
FIG. 6 is a schematic view showing connection relationships between a smelting chamber and a water-cooled electrode assembly and between a water-cooled electrode assembly and a heating unit of a metal forming apparatus according to an embodiment of the present disclosure.

As shown in FIGS. 5 and 6, the heating unit 003 is provided, for example, the heating unit 003 is fitted over the crucible 502 and is connected with the water-cooled electrode assembly 504. The water-cooled electrode assembly 504 has two electrodes 004 electrically connected with two ends of the heating unit 003 respectively. Both of the heating unit 003 and the two electrodes 004 may define a hollow structure therein, and a cooling liquid may be provided in the hollow structure. The cooling liquids may enter an interior of the heating unit 003 via the hollow structure of one electrode 004 and flows out via the hollow structure of the other electrode 004. In other words, a first water passage is defined in the heating unit 003 and a second water passage is defined in each of the two electrodes 004, in which the two second water passages are connected with two ends of the first water passage respectively. The cooling liquid enters the first water passage of the heating unit 003 via the second water passage of one electrode 004 to exchange heat with the heating unit 003, and then flows out via the second water passage of the other electrode 004.

As shown in FIG. 6, the two electrodes are disposed in and penetrated a side wall of the smelting chamber 501. The smelting device 5 further includes a sealing element 005 and a rotation arm 001. The sealing element 005 is fitted over an end of the electrode 004 located out of the smelting chamber 501 so as to seal a gap between the electrode 004 and the smelting chamber 501, and the rotation arm 001 is fixed on the sealing element 005 and is configured to drive the sealing element 005, the two electrodes 004 and the crucible 502 to rotate. In other words, a mounting hole is formed in the side wall of the smelting chamber 501, and the water-cooled electrode assembly 504 is disposed in and passed through the mounting hole, and the water-cooled electrode assembly 504 is sealed by the sealing element 005. The rotation arm 001 is disposed on the sealing element 005. In some embodiments, the sealing element 005 is sealedly connected with a side wall of the smelting chamber 501, and the sealing element 005 can rotate with respect to the side wall of the smelting chamber 501 about a rotation axis vertical to a direction of the mounting hole. The two electrodes 004 penetrate the sealing element 005 respectively and are extended parallel from an interior to an exterior of the smelting chamber 501, i.e. penetrate a side wall of the smelting device 5. The rotation arm 001 is fixed on an outer side of the sealing element 5 via a bolt. Under the action of an external force, the rotation arm 001 moves to drive the sealing element 005, the electrode 004 and the crucible 502 to rotate with respect to the smelting chamber 501 about the rotation axis vertical to the direction of the mounting hole. In this way, the process of feeding the raw material into the charging barrel assembly 81 via the rotation of the crucible 502 is achieved.

The water-cooled electrode assembly 504 is a key of the smelting device 5 and is connected with a servo motor to drive the crucible 502 to rotate along with the servo motor synchronously, such that a discharging speed of the molten raw material in the smelting device 5 can be adjusted, thus facilitating to correct discharging parameters of the molten raw material, such as a discharging speed and a discharging angle of the molten raw material.

Compared with a coaxial electrode, the water-cooled electrode 504 has following advantages: 1) the water-cooled electrode 504 has a small volume and can be adapted to a commonly-used die casting machine without causing a position interference, while the coaxial electrode has to make a huge change in size to work with the commonly-used die casting machine; 2) in the coaxial electrode, a glow discharge may occur after the vacuum space is electrified and an arcing discharge which can break the electrode may occur as well. However, in the electrode 004, there is only the glow discharge existed. Those having ordinary skill in the related art may understand, the glow discharge is a nature phenomenon after the vacuum space is electrified, which may merely result in a little energy loss to the electrode 004.

Figure 9:
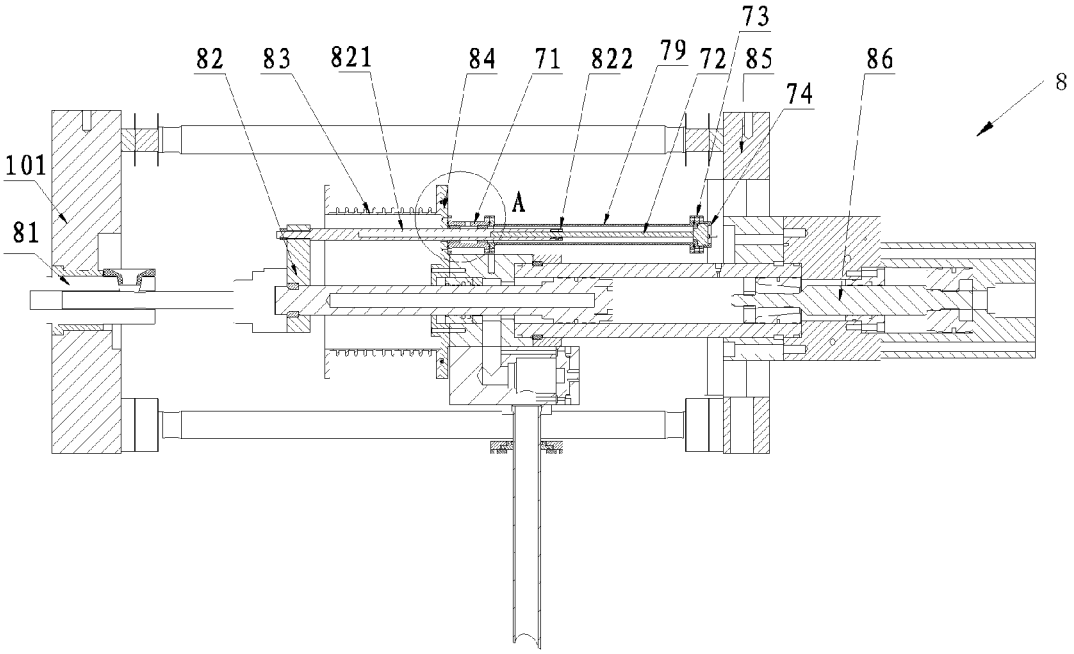
FIG. 9 is a schematic view of an injection device of a metal forming apparatus according to an embodiment of the present disclosure.

The water-cooled electrode assembly 504 is connected with a water-cooled cycle supply system 4 and a high frequency power source in the vacuum device 3 respectively. With the water-cooled electrode assembly 504, the metal alloy can be smelted, the molten raw material can be poured into the charging barrel assembly 81 (as shown in FIG. 9), and various kinds of cleaning and protecting actions can be implemented. By controlling the water-cooled electrode assembly 504, the molten raw material in the crucible 502 can be poured into the charging barrel assembly 81 directly, such that uncertain factors in various processes due to a higher discharging height will not occur. The discharging speeds of different molten alloy metals are different, but can be adjusted with the water-cooled electrode assembly 504, thereby various requirements for processing the different alloy metals may be satisfied.

The observing window 517 is sealedly connected with an observing window base 518 which is welded on the smelting chamber 501 via a high vacuum welding. Through the observing window 517, smelting conditions as well as rotating and injecting actions of the water-cooled electrode assembly 504 within the smelting device 5 can be observed directly. The smelting chamber 501 includes the vacuumizing assembly 503, the high vacuum gauge tube 507, the air discharging valve 513, the reserved port 505 and the vacuum meter 519, so that the vacuum and discharge conditions of the smelting chamber 501 can be controlled. The reserved port 505 is configured to connect with other elements for additional functions. An electromagnetic isolation valve, a gas passage sleeve and other standard vacuum elements are disposed on the inert gas port 509 and are connected together via corresponding connectors, so that the feeding time and the quantity of the inert gas may be controlled. The CCD terminal port 510 is disposed right above the crucible 502 in the smelting chamber 501 and is provided with an image sampling device and an infrared terminal probe. The image sampling device is configured to transfer the feedback information of the smelting process to the control system 6, thereby the operators may obtain information of the smelting condition in the crucible 502 at any time. The infrared terminal probe is configured to collect a temperature signal in real time and transfer the temperature signal to the control system 6.

The feeding port 508, the feeding passage 520 and the lead terminal assembly 506 are disposed on the smelting chamber 501 and cooperate with one another to implement the feeding process. The feeding port 508 is communicated with the crucible 502 via the feeding passage 520, and the lead terminal assembly 506 is a commonly-used wire for connecting a vacuum environment and an atmospheric environment. During the feeding, the feeding port 508 is open and the raw material enters the feeding passage 520. A sensor is disposed at the feeding passage 520 to detect whether the raw material is stuck or remained in the feeding passage 520, and sends a sensing signal to the control system 6 via the lead terminal assembly 506. The control system 6 is configured to determine possible conditions.

In some embodiments of the present disclosure, the metal forming apparatus 1000 further includes displacement speed monitoring device 7. The displacement speed monitoring device 7 is connected with the injection device 8 and is configured to detect operation parameters of the injection device 8.

The displacement speed monitoring device 7, the injection device 8 and an assembling relationship therebetween will be described in details in the following with reference to FIGS. 9-11.

As shown in FIGS. 9 and 10, the injection device 8 includes the charging barrel assembly 81, the injection unit, the vacuum seal bellow 83, an adapter flange 84 for the vacuum seal bellow 83 and a tail plate 85. The injection unit includes an injection rod assembly 82 and an injection power device 86. The injection rod assembly 82 includes an injection rod 821 and a magnet ring 822 disposed on the injection rod, in which a hammer header is disposed at a front end of the injection rod 821 and configured to inject the raw material. The magnet ring 822 is disposed at a rear end of the injection rod 821 to provide a position feedback of the injection rod 821. In some embodiments of the present disclosure, the injection rod 821 defines a sliding channel 823 therein, and the displacement speed monitoring device 7 further includes a linear displacement sensor 72 extended into the sliding channel 823. Moreover, the magnet ring 822 is fitted over the linear displacement sensor 72 and is fixed on a rear end surface of the injection rod 821.

The charging barrel assembly 81 is disposed on the head plate 101 and a pour opening 94 is formed at a top part of the charging barrel assembly 81 which is located within the smelting chamber 501, and the molten raw material may be poured by the crucible 502 into the pouring opening 94, and then the molten raw material may be poured into the charging barrel assembly 81, thus eliminating the discharging height. Therefore, an inner wall of the charging barrel assembly 81 cannot be corroded and a cooling consumption of the raw material can be decreased because the molten raw material can be poured into the charging barrel assembly 81 in a short time, thus no bad effects on the subsequent forming process may be reduced. Meanwhile, the charging barrel assembly 81 includes the temperature control system 1 which controls the temperature by a manner of heat cycling oil. Then the temperature of the molten raw material can be adjusted freely by adjusting a temperature of the temperature control system 1, thus requirements for maintaining temperatures of different raw metal materials may be satisfied. In some embodiments, a temperature maintenance layer is provided on the charging barrel assembly 81, thus, the temperature maintenance functions may be further improved.

The injection rod assembly 82 is configured to inject the molten raw material in the charging barrel assembly 81 and penetrates the smelting chamber 501 from the exterior of the smelting chamber 501, and an end of the injection rod assembly 82 is extended into the charging barrel assembly 81. The injection power device 86 is connected with a rear end of the injection rod assembly 82 and configured to provide power to the injection rod assembly 82. In other words, the injection power device 86 is connected with injection rod assembly 82 and is configured to drive the injection rod assembly 82 to move, so that the molten raw material in the charging barrel assembly 81 is injected into the molding device 10.

The injection rod assembly 82 and the injection power device 86 are positioned in a proper operation position via the head plate 101 and the tail plate 85. The injection power device 86 is sealedly connected with the vacuum seal bellow 83 via the adapter flange 84. In this way, the smelting device 5 and the injection device 8 are both operated in a sealed environment.

Two ends of the vacuum seal bellow 83 are sealedly disposed on the adapter flange 84 and the first flange 512 respectively, and the injection rod assembly 82 is disposed in and penetrates the vacuum seal bellow 83.

Figure 11:
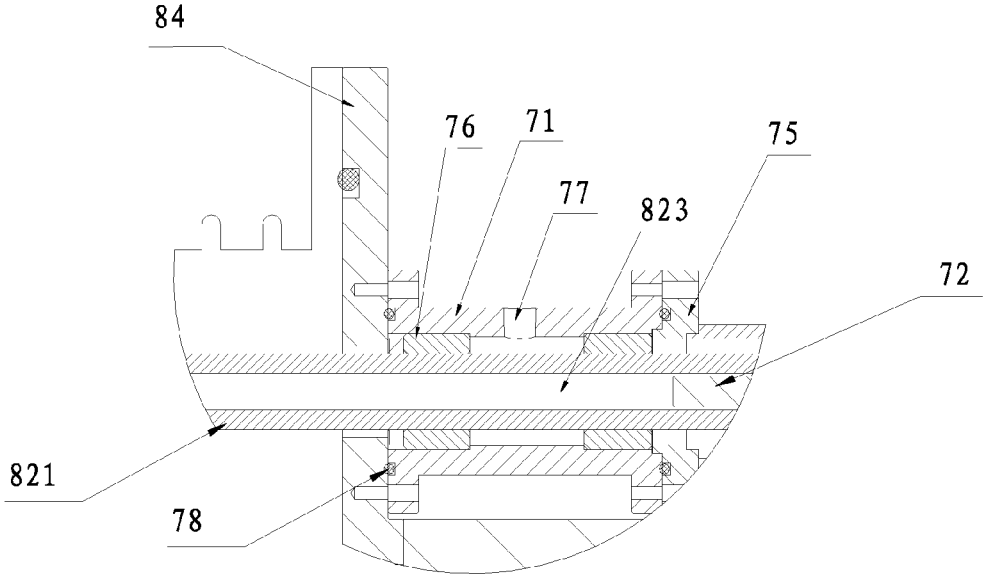
FIG. 11 is an enlarged view of part A in FIG. 9.

As shown in FIGS. 9-11, the displacement speed monitoring device 7 includes a guiding seal seat 71, the linear displacement sensor 72, a rear sealing cover 73, a sensor sealing cover 74, a sealing sleeve 75, a guiding copper ring 76 and an O-shape sealing ring 78. A lubricant filling hole 77 is formed in the guiding seal seat 71 and is penetrated the guiding seal seat 71 in a thickness direction of the guiding seal seat 71. Lubricating oil may be filled into the displacement speed monitoring device 7 via the lubricant filling hole 77 after the metal forming apparatus is assembled successfully or during the subsequent maintenance. In some embodiments, a housing 79 for containing the linear displacement sensor 72 is formed by the guiding seal seat 71 and the sealing sleeve 75, and the housing 79 is sealedly connected with the injection device 8. Moreover, the rear end of the injection rod 821 is extended into the housing 79, such that a front end of the linear displacement sensor 72 is located in the sliding channel 823.

In some embodiments, the guiding seal seat 71 is penetrated in a front-rear direction, and a static seal connection is formed between a front end of the guiding seal seat 71 and a rear end of the adapter flange 84 by the O-shape sealing ring 78. The injection rod 821 penetrates the guiding seal seat 71 and the rear end of the injection rod 821 is extended out of the guiding seal seat 71 so that the linear displacement sensor 72 is extended into the injection rod 821. The guiding copper ring 76 is disposed within the guiding seal seat 71 and is fitted over the injection rod 821. In some embodiments of the present disclosure, two guiding copper rings 76 are provided, and the two guiding copper ring 76 are fitted over the injection rod 821 and spaced apart from each other. The sliding channel 823 within the injection rod 821 is configured to contain the linear displacement sensor 72, and the magnet ring 822 adapted to provide a position feedback of the injection rod 821 is disposed on the injection rod 821.

The sealing sleeve 75 is fitted over the linear displacement sensor 72, for example, the linear displacement sensor 72 is fixed within the sealing sleeve 75, and a static seal connection is formed between a front end of the sealing sleeve 75 and a rear end of the guiding seal seat 71. The rear sealing cover 73 and the sensor sealing cover 74 both fitted with the linear displacement sensor 72 are disposed at a rear end of the sealing sleeve 75 so as to seal the linear displacement sensor 72 within the sealing sleeve 75.

In some embodiments, the sensor sealing cover 74 is fitted over a rear end of the linear displacement sensor 72, and the rear sealing cover 73 is fitted over the linear displacement sensor 72 and is located between the sensor sealing cover 74 and the rear end surface of the sealing sleeve 75. Moreover, the sensor sealing cover 74 is fitted with the rear sealing cover 73 so that the linear displacement sensor 72 is sealedly connected with the sealing sleeve 75. In other words, a static seal connection is formed between the linear displacement sensor 72 and the guiding seal seat 71 via the sealing sleeve 75, the rear sealing cover 73 and the sensor sealing cover 74, such that the whole displacement speed monitoring device 7 is disposed within the vacuum environment. With the displacement speed monitoring device 7 according to embodiments of the present disclosure, the static seal connection is provided, so that the vacuum seal can be improved if compared with a dynamic seal connection generally used in the related art. Furthermore, the pressure maintaining performance which is significant to a forming of the amorphous alloy can be also improved.

In some embodiments, the injection rod 821 can move back and forth in a straight line under an action of the guiding copper ring 76, and the hammer header can also move back and forth within the charging barrel assembly 81 so as to inject the molten raw material in the charging barrel assembly 81 into the molding chamber of the molding device 10. Moreover, the injection rod 821 can drive the magnet ring 822 to move with respect to the linear displacement sensor 72 to provide a position feedback of the hammer header in real time, thus implementing the data collecting of a displacement of the hammer header. Subsequently, the control system 6 calculates a moving speed of the hammer header according to the collected data, and then calculates an injection pressure based on the oil pressure data. Finally, key parameters of the injection device 8 can be obtained, the operators can set a proper injection pressure, displacement and moving speed to ensure a quantity of a final product according to the current injection pressure, displacement and moving speed, and specific requirements of the material should be considered as well.

A detection principle of the hammer header's displacement is shown as follows. The control system 6 sends a detecting signal with a frequency of 1 kHz to the linear displacement sensor 72. The linear displacement sensor 72 converts the detecting signal into a current pulse and transmits the current pulse to a waveguide disposed in the linear displacement sensor 72, and sends a starting signal back to the control system 6. The waveguide is a hollow metal tube with thin walls and has two terminals each connected with a wire for transmitting the current pulse. The current pulse is transmitted to the other end of the linear displacement sensor 72 along the waveguide at a high speed, such that a circumferential magnetic field is generated outside the waveguide. When the circumferential magnetic field intersects with a magnetic field generated by the magnet ring 822 fitted over the waveguide, a strain mechanical wave pulse signal is generated within the waveguide due to an action of magnetostriction. The strain mechanical wave pulse signal is transmitted at a constant sonic speed and can be detected by the linear displacement sensor 72 soon, at same time, the linear displacement sensor 72 sends a finishing signal to the control system 6. By recording a time difference between the starting signal and the finishing signal, the current position of the magnet ring 822 can be obtained, i.e., the current position of the hammer header can be obtained. The displacement of the hammer header can be obtained by calculating the displacing distance between the current position and an initial position of the hammer header.

In some embodiments of the present disclosure, the linear displacement sensor 72 is configured as a magnetostrictive linear displacement sensor 72. The linear displacement sensor 72 in embodiments of the present disclosure is not limited to this type and may also be configured as other types of linear displacement sensor, as long as being capable of detecting of the injection pressure, displacement and moving speed of the injection rod assembly 82, such as a cable-displacement sensor.

The injection pressure, displacement and moving speed of the injection rod assembly 82 are important parameters for the die casting and the molding processes. Different alloying metals with different parameters, so that the data collecting of these parameters is a key to the feedback and control of the parameters. Since the conventional determination technology cannot be operated in the vacuum and sealed environment, such that a relative detection method is adopted herein. With the injection rod 821 according to embodiments of the present disclosure, the linear displacement sensor 72 is placed within the injection rod 821, thereby a relative determination can be detected by the sensor 72 using the relative detection method, and the relative parameters can be obtained accordingly. Moreover, the injection force of the injection device 8 can be obtained by detecting an oil pressure and finally is sent to the control system 6. Meanwhile all the parameters may be displayed on a touch screen.

In some embodiments, the injection force of the injection device 8 can be detected by a hydraulic pressure sensor disposed on an injection cylinder and communicated with an interior of the injection cylinder. The hydraulic pressure sensor detects a slight deformation thereof caused by the hydraulic pressure in the injection cylinder, converts the deformation into a current signal ranging from 4 to 20 mA and sends the current signal to the control system 6. The control system 6 obtains a real-time pressure by detecting the current signal. Then, the real-time injection force can be obtained by multiplying the real-time pressure by an area of a cross-section of the injection cylinder. These parameters are also displayed in the touch panel.

In further embodiments of the present disclosure, the metal forming apparatus 1000 further includes a feeder 12. The feeder 12 is communicated with the feeding port 508, so that the raw material may be fed into the crucible 502 via the feeding port 508.

Figure 7:
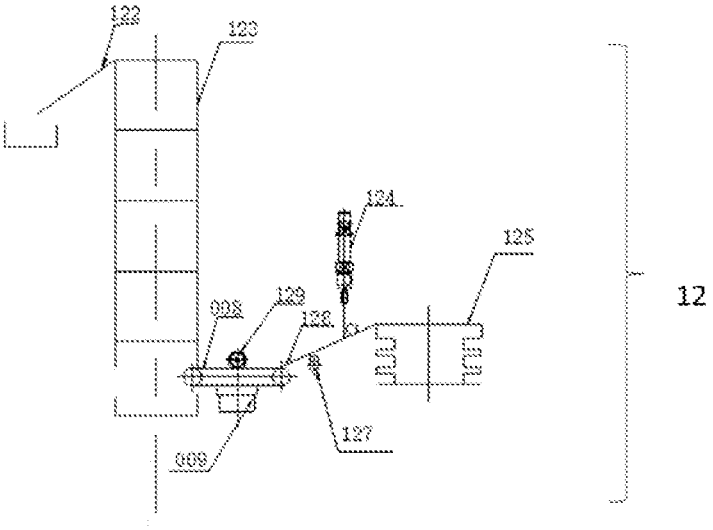
FIG. 7 is a schematic view of a feeder of a metal forming apparatus according to an embodiment of the present disclosure.

As shown in FIG. 7, the feeder 12 includes a guiding device 122, a lifting conveyer belt 123, a discharging controller 124 (such as an air cylinder), an oscillating screen 125, a counter 127, a transition belt 128, a screening device 129, a weighing conveyer belt 008 and a quality sensor 009. The weighting conveyer belt 008 is connected with the oscillating screen 125 via the transition belt 128, i.e., the transition belt 128 defines a first end connected with the oscillating screen 125 and a second end connected with the weighing conveyer belt 008. The lifting conveyer belt 123 defines a lower end connected with the weighting conveyer belt 008 and an upper end communicated with the feeding port 508 via the guiding device 122.

The counter 127 is configured to count a number of the raw material entering the weighting conveyer belt 008. The discharging controller 124 is connected with the counter 127 and is configured to prevent the extra raw material from being conveyed onto the weighting conveyer belt 008 when the counter 127 detects that the number of the raw material on the weighting conveyer belt 008 has met a predetermined number, such that the number of the raw material on the weighting conveyer belt 008 can be kept same each time. The quality sensor 009 is configured to detect whether the raw material on the weighting conveyer belt 008 is qualified. The screening device 129 is disposed on the weighting conveyer belt 008 and is configured to remove the unqualified raw material from the weighting conveyer belt 008. In some embodiments of the present disclosure, the quality sensor 009 and the screening device 129 are disposed on the weighting conveyer belt 008, and the screening device 129 is an air cylinder.

During operation of the feeder 12, the raw material with a regular shape is placed in the oscillating screen 125 in advance, and the oscillating screen 125 transmits the raw material onto the transition belt 128. During the process that the transition belt 128 transmits the raw material onto the weighing conveyer belt 008, the counter 127 counts the number of the raw material. When the predetermined number of the raw material on the weighing conveyer belt 008 is met, the discharging controller 124 stops the raw material entering onto the weighting conveyer belt 008 anymore. Meanwhile, the quality sensor 009 detects whether a predetermined number of the raw material on the weighting conveyer belt 008 is qualified. If the quality sensor 009 detects the raw material is qualified, the qualified raw material is transmitted to the lifting conveyer belt 123. Whereas, if the quality sensor 009 detects the raw material is unqualified, the screening device 129 removes the unqualified raw material to a predetermined position. Then the feeder 12 continues operating and the lifting conveyer belt 123 transmits the qualified raw material to the feeding port 508 via the guiding device 122, and then the qualified raw material is fed into the crucible 502.

Figure 8:
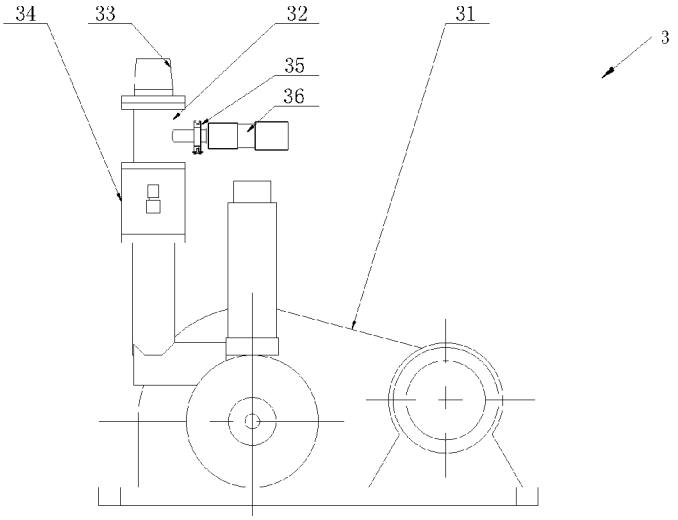
FIG. 8 is a schematic view of a vacuum device of a metal forming apparatus according to an embodiment of the present disclosure.

In some embodiments of the present disclosure, as shown in FIG. 8, the vacuum device 3 includes a vacuumizing unit 31, a three-way connection 32, a first connector 33, a pressure difference pneumatic valve 34, a second connector 35 and an electromagnetic valve 36. The first connector 33 is disposed on the vacuumizing unit 31 and is connected with the smelting chamber 501. The second connector 35 is disposed on the vacuumizing unit 31 and is connected with the smelting chamber 501.

The three-way connection 32 has a first port, a second port and a third port. The first port is connected with the vacuumizing unit 31, the second port is connected with the first connector 33, and the third port is connected with the second connector 35, in which a filter screen is disposed in each one of the second port and the third port, such that the raw material or dusts are prevented from entering into the vacuumizing unit 31.

The electromagnetic valve 36 is disposed on the three-way connection 32 and is configured to control to open or close the second port and the third port so as to control whether to vacuumize the smelting chamber 501 and the molding device 10. The pressure difference pneumatic valve 34 is disposed on the three-way connection 32 to protect the vacuum device 3 when a power supply is interrupted. The operation principle of the pressure difference pneumatic valve 34 is known by those skilled in the related art, thus details thereof are omitted herein.

An operating process of the metal forming apparatus 1000 according to embodiments of the present disclosure will be described in the following with reference to FIGS. 1-11, in which the metal forming apparatus 1000 further includes a vacuum detection system configured to detect the vacuum degree.

First, after the metal forming apparatus 1000 is powered on, the control system 6 performs a self-detection and detects an air pressure in the smelting chamber 501 and a cooling water pressure in the water-cooled cycle supply system 4. The control system 6 also determines whether each valve is in a normal position. If there is no abnormal condition detected from the above detections, the smelting device 5 is initialized to drive the crucible 502 corresponding to the feeding port 508, so that the metal forming apparatus 1000 starts a normal operation. If there is an abnormal condition detected, an alarm is triggered and error information is displayed on the man-machine operation interface of the control system 6.

The feeder 12 feeds the raw material into the crucible 502 within the smelting chamber 501 through the feeding port 508, and then the vacuum device 3 vacuumizes the smelting chamber 501, the molding device 10 and the injection device 8. When air pressures in each of the smelting chamber 501, the molding device 10 and the injection device 8 reach a required pressure, the heating unit 003 heats the raw material in the crucible 502 to obtain the molten raw material, and the molding device 10 is closed and heated to a required temperature.

During the smelting process, the CCD system 9 samples a video in the smelting device 5 in real time, and the operator can observe the conditions in the smelting device 5 via a display screen of the CCD system 9 to determine a smelting temperature based on operation experiences. Moreover, the smelting temperature can also be detected by an infrared temperature sensor and displayed on the man-machine operation interface of the control system 6. The control system 6 controls a power of the heating unit 003 according to a predetermined heating current and heating time, thus implementing an accurate multistage control of heating and temperature maintenance.

After the smelting process, the servo motor drives the water-cooled electrode assembly 504 and the crucible 502 to rotate so as to pour the molten raw material into the charging barrel assembly 81, and then the crucible 502 can be maintained in the pouring position for a proper time period to ensure that all the molten raw material has been poured into the charging barrel assembly 81. Then, the crucible 502 returns to a cooling position quickly and is cooled by the inert gas, thus ensuring that the temperature of the crucible 502 can be decreased to a temperature at which the molten raw material cannot be oxidized rapidly before the molding device 10 is open.

After the molten raw material in the crucible 502 is poured into the charging barrel assembly 81 and then a predetermined delay time is also passed, the injection unit of the injection device 8 performs a first speed injection and a second speed injection to inject the molten raw material from the charging barrel assembly 81 into the molding device 10 to form the metal element. During the injection process, the magnetostrictive linear displacement sensor 72 provides the position feedback of the hammer header at the front end of the injection rod 82 in real time, and the displacement speed monitoring device 7 calculates the real-time moving speed of the hammer header according to a position change of the hammer header. Meanwhile, the pressure sensor provides the injection pressure feedback of the injection device 8 in real time. Moreover, the displacement speed monitoring device 7 records the moving speed, displacement and injection pressure and shows the moving speed, displacement and injection pressure in the form of a curve graph. After the injection process is completed, a first stage speed, a second stage speed, a starting point of the second stage speed, a pressurization delay and a pressure starting time can be calculated automatically, which may be shown to the operators.

After the crucible 502 is cooled completely, the air discharging valve 513 is opened to weaken the vacuum environment within the smelting chamber 501. When the vacuum detection system determines the pressure of the vacuum environment is higher than a predetermined pressure limit, the air discharging valve 513 is delayed from closing, thus ensuring the pressure of the vacuum environment is substantially equal to the atmospheric pressure. Then, the molding device 10 is allowed to open and the formed metal element can be removed out.

Finally, the mold, the charging barrel and the hammer header are cleaned, and a next cycle for forming metal elements is prepared.

With the metal forming apparatus 1000 according to embodiments of the present disclosure, each of the vacuum degrees of the smelting device 5 and the injection device 8 may be reduced into a range of 5 Pa to 200 Pa in 2 to 20 seconds. Specifically, the vacuum degree may be reduced to a value as low as 10 Pa, and a pressure increase rate is less than or equal to 0.5 Pa per second, such that an excellent vacuum environment can be obtained in a short time. In some embodiments of the present disclosure, for the amorphous alloy having a high requirement for the vacuum degree, the metal forming apparatus 1000 according to embodiments of the present disclosure can reduce the vacuum degrees of the smelting device 5 and the injection device 8 to a value less than 100 Pa in 15 seconds. In addition, with the metal forming apparatus 1000, the specific parameters can be set on the apparatus and be adjusted in real time according to processing requirements of the product to be manufactured.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A metal forming apparatus, comprising:

an injection device comprising a moveable injection rod and a magnet ring disposed on the injection rod, the injection rod defining a sliding channel therein; and a displacement speed monitoring device comprising a housing sealedly connected to the injection device and a linear displacement sensor disposed in the housing, the housing comprising:

a guiding seal seat penetrated in a front-rear direction and defining a front end sealedly connected to an adapter flange; and a sealing sleeve defining a front end sealedly connected to a rear end of the guiding seal seat, wherein the linear displacement sensor is fixed in the sealing sleeve;

wherein a rear end of the injection rod is extended into the housing such that a front end of the linear displacement sensor is located in the sliding channel.

2. The metal forming apparatus of claim 1, wherein the injection device further comprises an adapter flange sealedly connected with the housing, the rear end of the injection rod is extended through the adapter flange into the housing.

3. The metal forming apparatus of claim 1, wherein:

a rear end of the sealing sleeve is open;

the displacement speed monitoring device further comprises a rear sealing cover and a sensor sealing cover;

the sensor sealing cover is fitted over a rear end of the linear displacement sensor;

the rear sealing cover is fitted over the linear displacement sensor and is located between the sensor sealing cover and a rear end surface of the sealing sleeve; and the sensor sealing cover is fitted with the rear sealing cover so that the linear displacement sensor is sealedly connected with the sealing sleeve.

4. The metal forming apparatus of claim 1, wherein the displacement speed monitoring device further comprises a guiding copper ring disposed within the guiding seal seat and fitted over the injection rod.

5. The metal forming apparatus of claim 1, wherein the displacement speed monitoring device comprises two guiding copper rings spaced apart from each other.

6. The metal forming apparatus of claim 1, wherein the guiding seal seat defines a lubricant filling hole penetrated in a thickness direction thereof.

7. The metal forming apparatus of claim 1, wherein an O-shape sealing ring is disposed between the guiding seal seat and the adapter flange.

8. The metal forming apparatus of claim 1, wherein the magnet ring is fitted over the linear displacement sensor and is fixed on the rear end of the injection rod.

9. The metal forming apparatus of claim 1, wherein the linear displacement sensor is configured as a magnetostrictive linear displacement sensor.

* * * * *